US006637440B2

(12) United States Patent
de Laforcade

(10) Patent No.: US 6,637,440 B2
(45) Date of Patent: Oct. 28, 2003

(54) DEVICE FOR APPLYING PRODUCT TO HAIR AND METHOD OF USING SAME

(75) Inventor: Vincent de Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 69 days.

(21) Appl. No.: 09/791,744

(22) Filed: Feb. 26, 2001

(65) Prior Publication Data

US 2001/0018920 A1 Sep. 6, 2001

(30) Foreign Application Priority Data

Feb. 25, 2000 (FR) ..... 00 02421

(51) Int. Cl.[7] ..... A45D 24/22

(52) U.S. Cl. ..... 132/112; 132/114; 132/113; 132/111

(58) Field of Search ..... 132/112, 113, 132/114, 115, 116, 143; 401/17, 25, 26, 27, 268

(56) References Cited

U.S. PATENT DOCUMENTS 3,101,086 A * 8/1963 Di Vito ..... 132/114
4,310,009 A * 1/1982 Shipp ..... 132/114
5,054,504 A * 10/1991 Winrow ..... 132/114
6,378,529 B1 * 4/2002 Marco ..... 132/111

OTHER PUBLICATIONS

English language translation of FR 2,769,806.

* cited by examiner

*Primary Examiner*—John J. Wilson
*Assistant Examiner*—Robyn Kieu Doan
(74) *Attorney, Agent, or Firm*—Finnegan, Henderson, Farabow, Garrett & Dunner, L.L.P.

(57) ABSTRACT

The present invention relates to a device for applying a product to hair. The device may include a dispensing head configured to be coupled to a container. The dispensing head may include an applicator member and a screen. The applicator member may include at least one tooth configured to be placed in contact with hair and moved with respect thereto. The applicator member may also include a duct extending in the at least one tooth along an axial length of the at least one tooth. The duct may be capable of being placed in flow communication with the container. The applicator member may also include an outlet orifice for the duct. The outlet orifice can be oriented to provide outlet flow of product in a direction transverse to an axis of the at least one tooth. The screen may be arranged such that the screen and the at least one tooth define a volume. The volume may be configured to be capable of receiving the product dispensed from the outlet orifice and of having the hair pass through the volume when the applicator member is moved along the hair. Also provided is a method of applying a product to hair.

93 Claims, 4 Drawing Sheets

DEVICE FOR APPLYING PRODUCT TO HAIR AND METHOD OF USING SAME

The present invention relates, in general, to a device for applying a product to hair and a method of applying a product to hair. In particular, the present invention relates to a device for applying a hair care product to hair and a method of applying a hair care composition to hair.

A certain number of novel formulas are coming to light at the present time in the area of hair coloration. These new formulas are increasingly in the form of a mousse and can be characterized as having a high coloration density.

The fact that these compositions are presented in the form of a mousse generally prevents the use of conventional applicators such as brushes, or applicator systems sometimes known as "applicator bottles". Some of these applicator bottles automatically mix two or more components (particularly a colorant and an oxidizing agent) involved in the composition of a coloration product, as well as apply the composition to the hair in a localized manner. When the composition is in the form of a mousse, the applicator system should be compatible with the composition packaged in the form of an aerosol.

High coloration density may also be problematical because it is liable to produce stains on the scalp, which may create an undesirable appearance for a consumer.

FR 2 776 629 describes an applicator system that can be fitted to an aerosol container. The applicator system comprises a brush with teeth embedded on an application face intended to face the scalp, and at the center of which, product outlet orifices emerge. Although satisfactory in numerous respects, an applicator such as this may, in certain instances, suffer from an inability to apply the product deeply into the head of hair.

Furthermore, applicators of the type with several teeth have been marketed, particularly in Japan. The teeth of these applicators typically have a product conveying duct which emerges either axially from the teeth or between the teeth roughly in the plane of the applicator member. In these configurations, the outlet orifices are oriented roughly at right angles to the direction of travel of the applicator member through the hair. With these applicators, the product comes into substantial contact with the scalp, which raises problems because of the staining nature of these coloration products.

One of the optional aspects of the present invention is directed to a device for applying a product to hair that may solve the problems discussed above with reference to the conventional devices.

An optional aspect of the invention is directed to a device for applying a product to hair that may allow the product to be applied deeply into the head of hair and may reduce staining of the scalp.

Another optional aspect of the invention is to provide a device for applying a product to hair that may be both simple and economical to produce.

A further optional aspect of the invention is to provide a device for applying a product to hair that may be both efficient and simple to use.

Still other aspects will become apparent from the detailed description which follows. It should be understood that the invention could be practiced without necessarily having one or more of the aspects described herein.

According to one aspect, the invention includes a device for applying a product to hair. The device may include a dispensing head configured to be coupled to a container. The dispensing head may include an applicator member and a screen. The applicator member may include at least one tooth configured to be placed in contact with hair and moved with respect thereto. The applicator member may also include a duct extending in the at least one tooth along an axial length of the at least one tooth. The duct may be capable of being placed in flow communication with the container. The applicator member may also include an outlet orifice for the duct, wherein the outlet orifice is oriented to provide outlet flow of product in a direction transverse to an axis of the at least one tooth. The screen may be arranged such that the screen and the at least one tooth define a volume. The volume may be configured to be capable of receiving the product dispensed from the outlet orifice and of having the hair pass through the volume when the applicator member is moved along the hair.

In another aspect, the device may include at least one container having an interior for containing a product. The device may also include a product contained in the interior of the container. The product may be a hair care product and the volume may be capable of holding the hair care product such that the hair can pass through the hair care product. The product may also be a hair coloring composition, which may be in the form of a mousse.

In yet another aspect, a substantial portion of the duct may be arranged axially within the at least one tooth. The outlet orifice may open transverse to the substantial portion of the duct.

In another aspect, the outlet orifice may be oriented substantially in the direction of travel of the applicator member as product is applied to hair.

In still another aspect, the at least one tooth may comprise a plurality of teeth. At least two of the plurality of teeth may each include a respective axially extending duct capable of being placed in flow communication with a container, and a respective duct outlet orifice, which may be oriented to provide outlet flow of product in a direction transverse to axes of the at least two teeth. The applicator member may also include a product distributing flow path configured to distribute product from the container to each duct of the at least two teeth.

In another aspect, the applicator member may comprise a plurality of teeth where the plurality of teeth define a first surface and a second surface. The first surface may be intended to face the scalp when product is being applied. The second surface may be oriented in a direction opposite the first surface, and the outlet orifice may be along the second surface.

In another aspect, the device may include a dispensing element, such as a valve or pump, capable of being actuated to allow the product to be dispensed from the container.

In a further aspect, the at least one tooth may include a free end, and the outlet orifice may be located near the free end of the at least one tooth. The outlet orifice may be located at a distance ranging about 0.5 mm to about 10 mm from the free end of the at least one tooth. The outlet orifice may be located at a distance ranging from about 1 mm to about 5 mm from the free end of the at least one tooth.

In still another aspect, the applicator member has a first width, and the screen has a second width, which may range from substantially equal to the first width of the applicator member to wider than the first width.

In another aspect, a surface of the screen facing the applicator member may be substantially flat or slightly concave. The screen may include lateral edging.

In a further aspect, the at least one container has a longitudinal axis, and the screen has a mean plane, which may form an angle with the longitudinal axis of the container ranging from about 0° to about 25°. The angle may also range from about 0° to about 10°.

In another aspect, the at least one tooth of the applicator member may define a plane, and the screen has a mean plane, which may form a non-zero angle with the plane of the applicator member. The volume may be between the applicator member and the screen. The angle may range from about 10° to about 60°. The angle may also range from about 20° to about 50°. The at least one container has a longitudinal axis, and the axis and the plane defined by the at least one tooth may form a second angle smaller than 90°. The second angle may range from about 30° to about 60°.

In another aspect, the at least one container has a longitudinal axis, and the dispensing head may be configured such that the applicator member has an angular position that is adjustable with respect to the longitudinal axis of the at least one container. The dispensing head may also be configured such that the screen has an angular position that is adjustable with respect to the longitudinal axis of the at least one container.

In another aspect, the at least one tooth may include first and second opposite ends. The first end may be a free end. The screen may include first and second opposite ends. The second end of the screen may be connected to the applicator member near the second end of the at least one tooth. The at least one tooth has a length defined by the first and second ends of the at least one tooth. The first and second ends of the screen are separated by a distance that may be substantially equal to length of the at least one tooth.

In yet another aspect, the product may be contained under pressure in the at least one container. The device may include a dispensing valve on the at least one container. The dispensing head may include a pressing surface capable of being pressed for actuating the dispensing valve to allow the product to be dispensed.

In another aspect, the dispensing head may be formed of a single piece by molding.

According to the present invention, there is also a method of applying a product to hair. The method includes providing a device as described above. The method also includes dispensing product from the container to the volume via the duct and the outlet orifice, and passing hair through the volume to apply product to the hair.

In another aspect, the product of the method may include a hair coloring composition. The hair coloring composition may include at least first and second components. The first component may be a colorant and the second colorant may be chosen from an oxidizing agent and a hair care composition.

In another aspect, the method may include moving the applicator member in a direction substantially parallel to the direction of the outlet orifice flow of product through the outlet orifice.

In yet another aspect, the at least one tooth may include a free end, and the method includes placing the free end adjacent the scalp.

Besides the structural and procedural arrangements set forth above, the invention could include a number of other arrangements, such as those explained hereinafter. It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 shows a device for applying a product to hair;

Figure 1:
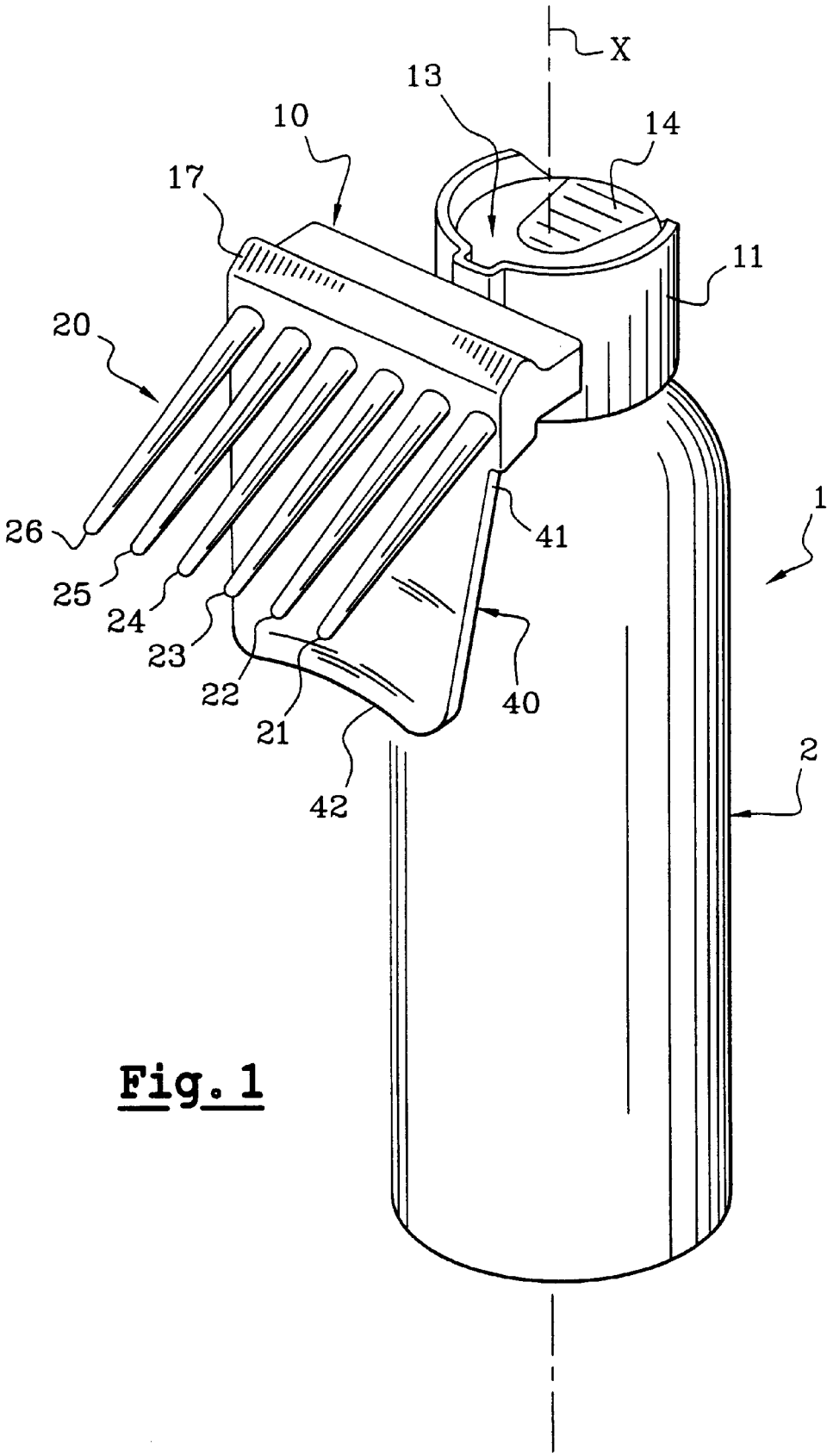
Figure 2:
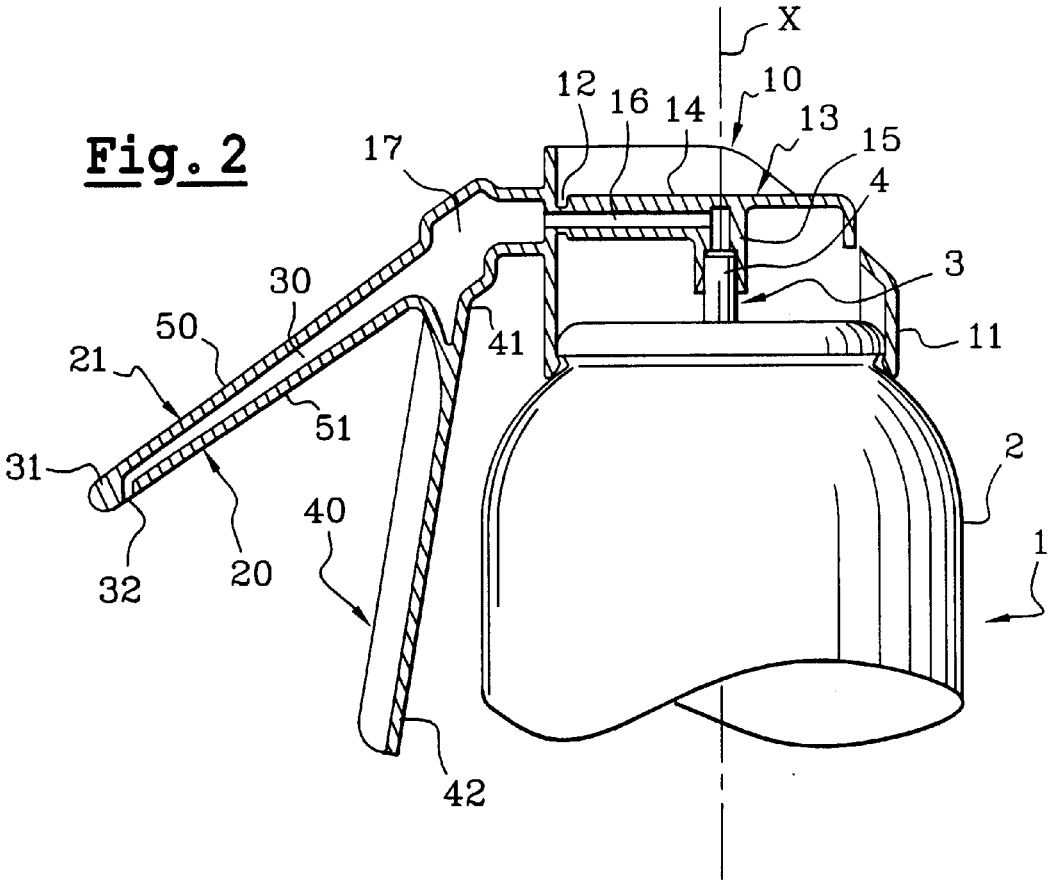
FIG. 2 shows a partial cross-section of the device of FIG. 1.
Figure 3:
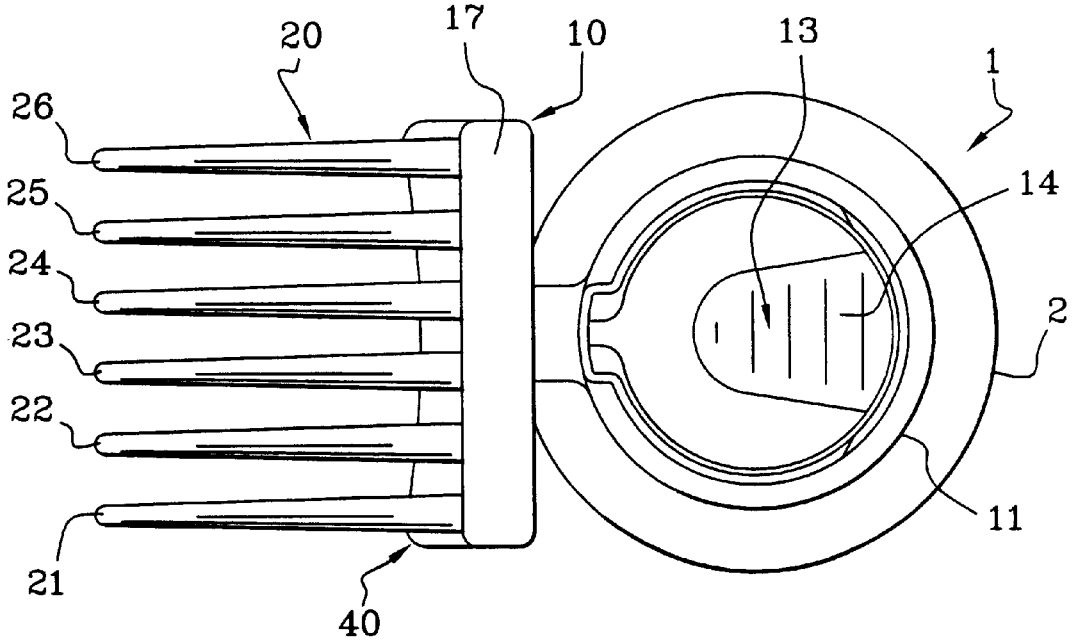
FIG. 3 shows a top plan view of the device of FIG. 1.

The device 1 shown in FIGS. 1–4 comprises a container 2 having an axis X and an interior for containing a product P. The container 2 may be made of aluminum or tin plate. The product P may be a hair coloring composition. The hair coloring composition may be made up of at least two components, one of which can be a colorant and the other of which can be an oxidizing agent and/or a hair care composition. Furthermore, it does not necessarily have to be a coloration composition. Other hair care products, such as those that might irritate or stain the scalp, may be utilized in the device. In addition, the product may take the form of a mousse, a gel, or a cream.

The container 2 may be surmounted by a dispensing valve 3 that may include a valve stem 4. The dispensing valve 3 may be any type of conventional valve, for example, a push-action or tilt-action valve. The dispensing valve 3 may have a valve body inside of which a shut-off member can be coupled to the valve stem 4. In a rest position, the shut-off member may be in sealed contact with a seal. The seal may be broken when lateral or axial pressure is applied to a pressing surface 14. Return means may return the valve to the closed position when the actuating pressure ceases.

In other embodiments, the product P may be dispensed by a manually operated pump. In another alternative, the product can be let out under pressure by pressing manually on flexible walls of a container containing the composition. In this arrangement dispensing could occur through an opening of the container. The product could be expelled through the opening of the container in response to pressure applied to the walls of the container.

The dispensing head 10 may comprise a body (or band) 11 intended for attaching the dispensing head 10 onto an edge of a dish carrying the dispensing valve 3. In one embodiment, the dispensing head 10 may be attached by snap-fastening. Alternatively, the band 11 may be screw-fastened onto the container 2. Optionally, the band 11 could be permanently connected to the container 2. The band 11 can be connected by a film hinge 12 to a part forming a push-button 13. The push-button 13 may comprise a pressing surface 14 that can actuate the valve when pressure is exerted roughly along the axis X of the container 2 on the pressing surface 14. An axial skirt 15 of the dispensing head 10 can be force-fitted onto the valve stem 4. The axial skirt 15 can be formed as an integral part of the push-button 13. The axial skirt 15 can include a radial duct 16 that opens into a product distributing flow path 17, at an end away from the axial skirt 15. This product distributing flow path 17, which can also be called a "splitter," can distribute the product across the entire width of an applicator member 20.

Figure 4:
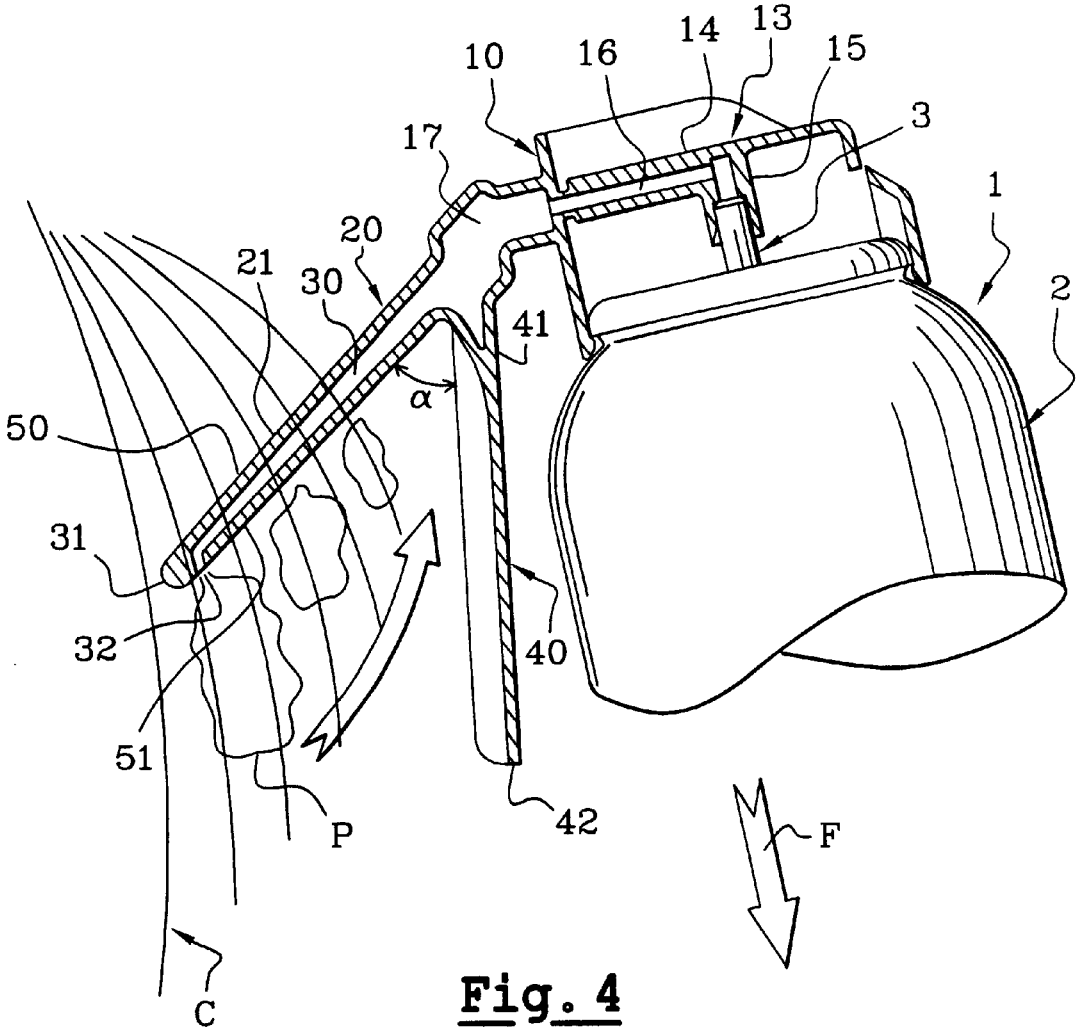
FIG. 4 shows a method of applying product to hair using the device of FIG. 1.

The applicator member 20 may comprise a number of teeth 21–26 that can be arranged in a plane forming an angle of about 60° with the axis X of the container 2. The teeth 21–26 can be spaced substantially uniformly apart, and may be separate by a few millimeters. In one embodiment, the teeth 21–26 can extend over a length of about 5 cm and have external cross-sections that taper slightly towards their free ends 31. Thus arranged, the teeth can define a first face 50, which may be furthest from the container and can face towards the scalp as shown in FIG. 4. The teeth can also define a second face 51, which may be referred to as an "application" face 51, on the opposite side to the face 50. Upon application, the face 50 may form an angle with the scalp of between 20 and 90°, and preferably between 20 and 60°. Each of the faces 50, 51 may be flat or form a "dome" similar to the "dome" of the scalp C. When the composition is being applied to the hair, the device may be moved through the hair. During this movement, the teeth may separate the hair into locks and slide along them to apply the product. Movement can be from the root of the hair to the tip.

Each of the teeth 21–26 may have a duct 30 extending from the product distributing flow path 17 nearly up to the free ends 31 of the teeth 21–26. The ducts 30 may pass longitudinally through the teeth 21–26. At the free ends 31, the ducts 30 can open onto the second face 51 via outlet orifices 32 oriented transversely to the longitudinal axis of the teeth 21–26 and oriented substantially in the direction of motion of the applicator member with respect to the hair. By orienting the outlet orifices 32 roughly in the direction of motion of the applicator member 20 with respect to the hair, and by keeping the ends of the teeth 21–26 roughly against the scalp, the product can be kept away from the scalp to avoid significant staining thereof. Furthermore, the head of hair can be soaked to a great depth. In a preferred embodiment, the outlet orifices 32 can be oriented so they lie inside a cone centered on the direction of motion, the vertex of the cone preferably being oriented towards the roots of the hair. The vertex angle of the cone may at most be equal to 45°. In another embodiment, the vertex angle of the cone may at most be equal to 30°.

The outlet orifices 32 can be formed close to the free ends 31 of the teeth 21–26 without opening into the axis of the teeth. While the outlet orifices 32 remain distant from the free ends 31, it is possible to soak the head of hair throughout its thickness, rather than simply at the surface. By way of example, the outlet orifices 32 can be positioned from the free ends 31 by a distance ranging from 0.5 mm to 10 mm. Typically, the outlet orifices 32 can be formed about 1 mm away from the free ends 31 of the teeth 21–26. The outlet orifices 32 can open onto the face 51 at substantially right angles to the axis of the teeth, or at an angle other than 90°, so long as the product P conveyed by the teeth is directed to a volume delimited in part by the teeth 21–26 and a screen 40, which will be described below. In one embodiment, each of the outlet orifices 32 may be centered on a plane passing through the axis of the tooth into which it opens, and perpendicular to the mean plane in which the applicator member 20 extends.

The screen 40 has a first end 41 adjacent to the product distributing flow path 17 and an second end 42 opposite to the end 41. The first end 41 may also be located near the ends of the teeth 21–26 opposite the free ends 31. The distance separating the ends 41 and 42 may roughly correspond to the length of the teeth 21–26.

Figure 5:
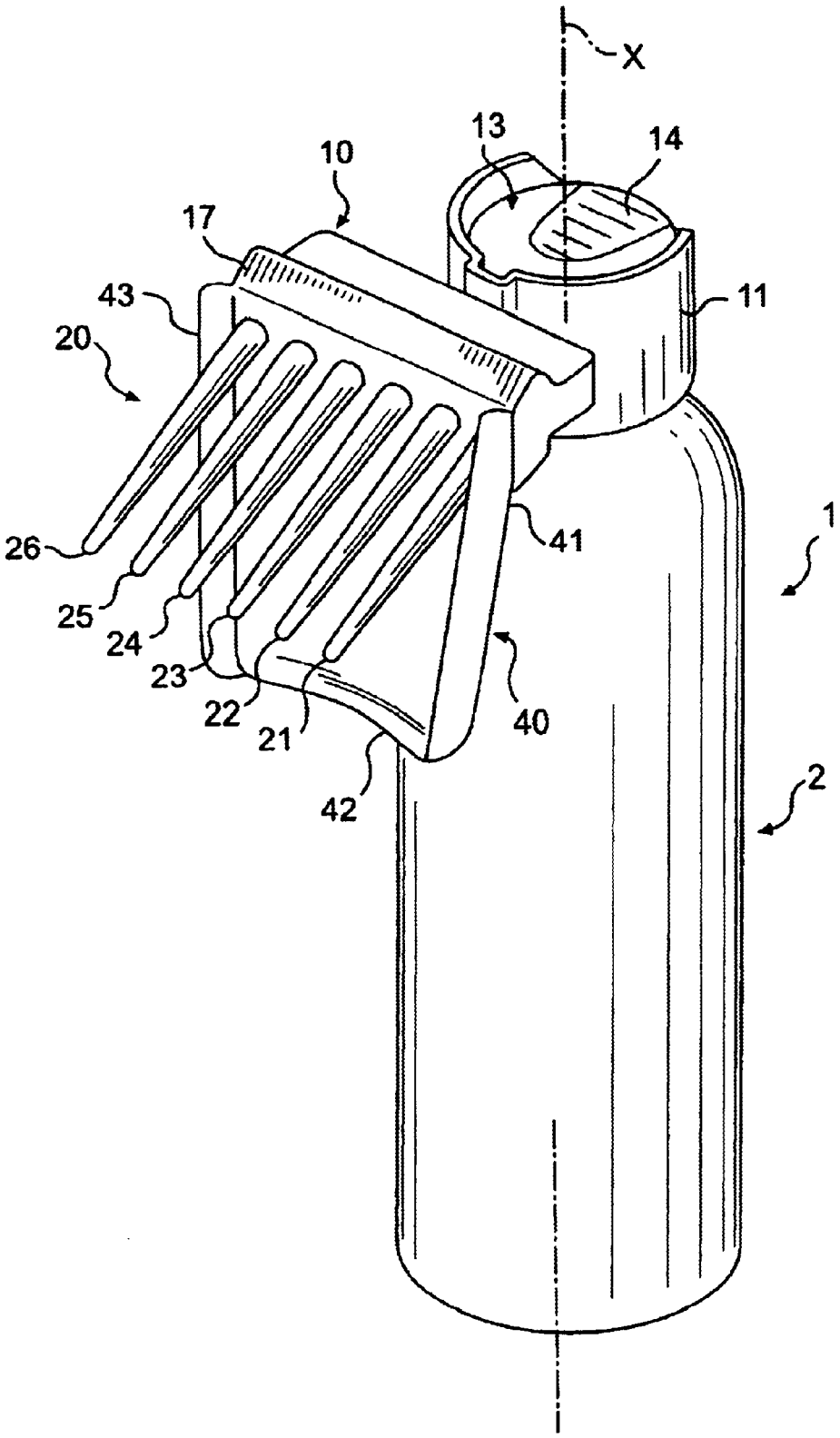
FIG. 5 shows an alternative embodiment of the device of FIG. 1.

The screen 40 can have a width substantially equal or slightly greater than the width over which the teeth 21–26 extend. The screen 40 can be substantially flat or have a slightly concave shape, in which the concave side may face towards the teeth 21–26. In another embodiment, as shown in FIG. 5, the screen 40 may be bordered laterally with lateral edgings 43 extending at right angles to the mean plane in which the screen-forming member extends. The presence of such lateral edgings 43 can make it possible to laterally restrict the diffusion of the product that has passed through the thickness of the head of hair.

The screen can make it possible for the product to be held in a localized way in a zone into which the hair can pass deeply, and thereby become significantly soaked. Thus the product can soak the hair starting from the root. The excess product may leave the head of hair and remain located between the applicator member 20 and the screen 40, thus making it possible to impregnate the hair from the surface of the head of hair. Furthermore, the screen may allow the user to avoid soiling his or her hands with the product.

The screen 40 can extend in a mean plane that makes an angle $\alpha$ of about 45° with the plane containing the teeth 21–26. In other embodiments, the mean plane of the screen 40 can form an angle with the axis X of the container 2 ranging from 0 to 25°. The mean plane of the screen can also form an angle with the axis of the container ranging from 0 to 10°.

In another embodiment, the teeth 21–26 of the applicator member 20 can be formed roughly in a plane that forms a non-zero angle with respect to the mean plane of the screen 40. Such an angle may range from 10° to 60°. In another embodiment, the angle is preferably from 20° to 50°. The angle may be chosen according to the type of head of hair to which the product is to be applied.

The plane formed by the applicator member 20 can make an angle smaller than 90° with the axis X of the container 2. In another embodiment, the angle can range from 30° to 60°. Such angles can assist in making the action involved in applying the product easier, as well as ensure correct orientation of the stream of the composition to be applied with respect to the head of hair and with respect to the scalp.

In a preferred embodiment, the coupling between the applicator member 20 and the screen 40 may be at a fixed angular position or variable angular position so that the angle that one makes with respect to the other can be varied as desired. The variable angle arrangement may be provided by including a flexible portion (e.g., flexible material) or a hinge on the applicator member 20 and/or screen 40 so that the user can vary the orientation of the teeth 21–26 and/or the screen 40. Such an arrangement might also be used to vary the angle of the teeth 21–26 and/or screen 40 with respect to the container 2. This may allow a user to tailor the overall configuration of the device to suit the user's anatomy, the user's preferred action, or the configuration of a particular zone of the head of hair where the product is to be applied.

The dispensing head 10 can be formed as a unitary, integral piece using molding techniques that combine the injection-molding of plastic, for example, a polypropylene (PP), a polyethylene (PE), a polyethylene terephthalate (PET) or a polyvinyl chloride (PVC), and the blowing of a pressurized gas so as to define the recessed parts of the dispensing head 10 including the ducts 30 of the applicator member 20. If less expensive molds are preferred, the dispensing head can be made in two or more parts that can then be assembled using known assembly techniques, taking care to ensure the necessary tightness between the various parts thus assembled.

One method of using the device 1 is shown in FIG. 4. The user places the end 31 of the teeth 21–26 so that they be adjacent to (e.g., press against or be slightly spaced from) the scalp C. The user can then impart a downward movement F to the container 2, holding the latter roughly parallel to the surface of the scalp C. With such a movement, the outlet orifices 32 may be oriented roughly along the line of motion. During this movement, the user actuates the dispensing valve 3 by depressing the surface 14 of the push-button 13, causing the product P to exit via the valve stem 4 to the radial duct 16. The product P then enters into the product distributing flow path 17, where it may be distributed substantially uniformly to each of the teeth 21–26. The product P passes through the ducts 30 and out of the outlet orifices 32, before emerging from the second face 51 of the applicator member 20. The product P soaks the hair inserted between the teeth 21–26, starting from the root. Because of the orientation of the orifices, the product may not be directed onto the scalp C, which limits the staining thereof. Excess product P can come back out of the hair and become lodged between the teeth 21–26 of the applicator member 20 and the screen 40, which allows the hair to be impregnated from its surface. The method can apply the product P to the hair both deep down and at the surface.

The user may perform the same operation again over the rest of the head of hair until the head of hair has been fully treated.

It will be apparent to those skilled in the art that various modifications and variations can be made to the structure and methodology of the present invention without departing from the scope or spirit of the invention. In view of the foregoing, it is intended that the present invention covers modifications and variations of this invention, provided that they fall within the scope of the following claims and their equivalents. For example, in the context of applying color in streaks, it is possible to provide an applicator member that has just one or even two teeth, so as to reduce the application width to the desired width of the streak. Additionally, in the case of coloration products in two components (a colorant and an oxidizing agent), it is possible to envisage a device in which two aerosol containers (one containing the colorant and the other containing the oxidizing agent) are combined. The two aerosol containers can be joined together by a single dispensing head, part of which forms a push-button for simultaneous actuation of the two valves. As they leave their respective container, the two products may be mixed in an appropriate zone. The mixture may then be directed to a single applicator member similar to the one described above.

In view of the foregoing, it is intended that the present invention covers modifications and variations of this invention, provided that they fall within the scope of the following claims and their equivalents.

What is claimed is:

1. A device for applying a product to hair, the device comprising:

a dispensing head configured to be coupled to a container, the dispensing head comprising an applicator member and a screen;

the applicator member comprising:

at least one tooth configured to be placed in contact with hair and moved with respect thereto, a duct extending in the at least one tooth along an axial length of the at least one tooth, the duct being capable of being placed in flow communication with the container, and an outlet orifice for the duct, the outlet orifice being oriented to provide outlet flow of product in a direction transverse to an axis of the at least one tooth; and the screen being arranged such that the screen and the at least one tooth define a volume configured to be capable of receiving the product dispensed from the outlet orifice and of having the hair pass through the volume when the applicator member is moved along the hair.

2. The device according to claim 1, further comprising at least one container including an interior for containing a product.

3. The device according to claim 2, further comprising product contained in the interior of the container.

4. The device according to claim 3, wherein the product is a hair care product and the volume is capable of holding the hair care product such that the hair can pass through the hair care product.

5. The device according to claim 3, wherein the product is a hair coloring composition.

6. The device according to claim 5, wherein the hair coloring composition is in the form of a mousse.

7. The device according to claim 1, wherein a substantial portion of the duct is arranged axially within the at least one tooth.

8. The device according to claim 7, wherein the outlet orifice opens transverse to the substantial portion of the duct.

9. The device according to claim 1, wherein the outlet orifice is oriented substantially in the direction of travel of the applicator member as product is applied to hair.

10. The device according to claim 1, wherein the at least one tooth comprises a plurality of teeth, wherein at least two of the plurality of teeth each include a respective axially extending duct capable of being placed in flow communication with a container, and a respective duct outlet orifice oriented to provide outlet flow of product in a direction transverse to axes of the at least two teeth, and wherein the applicator member further includes a product distributing flow path configured to distribute product from the container to each duct of the at least two teeth.

11. The device according to claim 1, wherein the applicator member comprises a plurality of teeth, the plurality of teeth defining a first surface and a second surface, wherein the first surface is intended to face the scalp when product is being applied, wherein the second surface is oriented in a direction opposite the first surface, and wherein the outlet orifice is along the second surface.

12. The device according to claim 3, further comprising a dispensing element capable of being actuated to allow the product to be dispensed from the container.

13. The device according to claim 1, wherein the at least one tooth includes a free end, and the outlet orifice is located near the free end of the at least one tooth.

14. The device according to claim 13, wherein the outlet orifice is located at a distance ranging from about 0.5 mm to about 10 mm from the free end of the at least one tooth.

15. The device according to claim 14, wherein the outlet orifice is located at a distance ranging from about 1 mm to about 5 mm from the free end of the at least one tooth.

16. The device according to claim 1, wherein the applicator member has a first width; and the screen has a second width ranging from substantially equal to the first width to wider than the first width of the applicator member.

17. The device according to claim 1, wherein a surface of the screen facing the applicator member is substantially flat.

18. The device according to claim 1, wherein a surface of the screen facing the applicator member is slightly concave.

19. The device according to claim 1, wherein the screen includes lateral edging.

20. The device according to claim 2, wherein the at least one container has a longitudinal axis; and the screen has a mean plane forming an angle with the longitudinal axis of the container ranging from about 0° to about 25°.

21. The device according to claim 20, wherein the angle ranges from about 0° to about 10°.

22. The device according to claim 2, wherein the at least one tooth of the applicator member defines a plane; and the screen has a mean plane forming a non-zero angle with the plane of the applicator member, the volume being between the applicator member and the screen.

23. The device according to claim 22, wherein the angle ranges from about 10° to about 60°.

24. The device according to claim 22, wherein the angle ranges from about 20° to about 50°.

25. The device according to claim 22, wherein the at least one container has a longitudinal axis; and the axis and the plane defined by the at least one tooth form a second angle smaller than 90°.

26. The device according to claim 25, wherein the second angle ranges from about 30° to about 60°.

27. The device according to claim 2, wherein the at least one container has a longitudinal axis, and wherein the dispensing head is configured such that the applicator member has an angular position that is adjustable with respect to the longitudinal axis of the at least one container.

28. The device according to claim 27, wherein the dispensing head is configured so that the screen has an angular position that is adjustable with respect to the longitudinal axis of the at least one container.

29. The device according to claim 2, wherein the at least one container has a longitudinal axis, and wherein the dispensing head is configured so that the screen has an angular position that is adjustable with respect to the longitudinal axis of the at least one container.

30. The device according to claim 1, wherein the at least one tooth includes first and second opposite ends, the first end being a free end, and wherein the screen includes first and second opposite ends, the second end of the screen being connected to the applicator member near the second end of the at least one tooth.

31. The device according to claim 30, wherein the at least one tooth has a length defined by the first and second ends of the at least one tooth, and wherein the first and second ends of the screen are separated by a distance substantially equal to the length of the at least one tooth.

32. The device according to claim 3, wherein the product is contained under pressure in the at least one container.

33. The device according to claim 32, further comprising a dispensing valve on the at least one container, and wherein the dispensing head includes a pressing surface capable of being pressed for actuating the dispensing valve to allow the product to be dispensed.

34. The device according to claim 1, wherein the dispensing head is formed of a single piece by molding.

35. A method of applying a product to hair, the method comprising:

providing the device according to claim 3;

dispensing product from the container to the volume via the duct and the outlet orifice; and passing hair through the volume to apply product to the hair.

36. The method of claim 35, wherein the product comprises a hair coloring composition.

37. The method of claim 36, wherein the hair coloring composition includes at least first and second components, the first component being a colorant and the second component being chosen from an oxidizing agent and a hair care composition.

38. The method of claim 35, further comprising moving the applicator member in a direction substantially parallel to the direction of the outlet flow of product through the outlet orifice.

39. The method of claim 35, wherein the at least one tooth includes a free end, and wherein the method further comprises placing the free end adjacent to the scalp.

40. A device for packaging and applying a product to hair, the device comprising:

at least one container having a longitudinal axis and being configured to contain the product; and a dispensing head configured to be coupled to the container, the dispensing head comprising an applicator member comprising a plurality of teeth located in a plane that forms a non-zero angle with respect to the longitudinal axis of the at least one container, the plurality of teeth defining a first face and a second face, the first face facing in a direction toward the at least one container and the second face facing in a direction substantially opposite to the first face when the dispensing head is coupled to the container, a duct passing through an axial length of at least one of the plurality of teeth, the duct being capable of being placed in flow communication with the container, and an outlet orifice for the duct, the outlet orifice opening onto the first face of the applicator member, wherein the at least one tooth having the duct does not include an outlet orifice opening onto the second face.

41. The device of claim 40, wherein at least one of the plurality of teeth is intended, with a view to applying the product, to be engaged with the hair and moved longitudinally with respect thereto.

42. The device of claim 40, wherein the plane forms an acute angle with the longitudinal axis of the at least one container.

43. The device of claim 40, wherein the plurality of teeth located in the plane comprises at least three teeth.

44. The device according to claim 40, further comprising the product in the at least one container, wherein the product is a hair composition.

45. The device according to claim 44, wherein the hair composition is in the form of a mousse.

46. The device according to claim 40, wherein the outlet orifice opens transverse to a substantial portion of the duct.

47. The device according to claim 40, wherein the outlet orifice is oriented substantially in the direction of travel of the applicator member as the product is applied to hair.

48. The device according to claim 40, further comprising a dispensing element capable of being actuated to allow the product to be dispensed from the container.

49. The device according to claim 40, wherein the outlet orifice is located near a free end of the at least one tooth having the duct.

50. The device according to claim 49, wherein the outlet orifice is located at a distance ranging from about 0.5 mm to about 10 mm from the free end of the at least one tooth having the duct.

51. The device according to claim 40, wherein the dispensing head is configured such that the applicator member has an angular position that is adjustable with respect to the longitudinal axis of the at least one container.

52. The device according to claim 44, wherein the product is contained under pressure in the at least one container.

53. The device according to claim 52, further comprising a dispensing valve on the at least one container, and wherein the dispensing head includes a pressing surface capable of being pressed for actuating the dispensing valve to allow the product to be dispensed.

54. The device according to claim 40, wherein the dispensing head is formed of a single piece by molding.

55. A method of applying a product to hair, the method comprising:

providing the device according to claim 44;

dispensing the product from the container via the duct and the outlet orifice; and moving the applicator member along the hair to apply the product to the hair.

56. The method according to claim 55, further comprising orienting the outlet orifice in a direction substantially the same as a direction of motion of the applicator member.

57. The method according to claim 55, further comprising orienting the applicator member so that the product is not directed onto a scalp of a user.

58. A device for packaging and applying a product to hair, the device comprising:

at least one container having a longitudinal axis and being configured to contain the product; and a dispensing head configured to be coupled to the container, the dispensing head comprising an applicator member comprising a plurality of teeth comprising at least three teeth, the plurality of teeth being located in a plane that forms a non-zero angle with respect to the longitudinal axis of the at least one container, the plurality of teeth defining a first face and a second face, the first face facing in a direction toward the at least one container and the second face facing in a direction substantially opposite to the first face, a duct passing through an axial length of at least one of the plurality of teeth, the duct being capable of being placed in flow communication with the container, and an outlet orifice for the duct, the outlet orifice opening onto the first face.

59. The device of claim 58, wherein at least one of the plurality of teeth is intended, with a view to applying the product, to be engaged with the hair and moved longitudinally with respect thereto.

60. The device of claim 58, wherein the plane forms an acute angle with the longitudinal axis of the at least one container.

61. The device according to claim 58, further comprising the product in the at least one container, wherein the product is a hair composition.

62. The device according to claim 61, wherein the hair composition is in the form of a mousse.

63. The device according to claim 58, wherein the outlet orifice opens transverse to a substantial portion of the duct.

64. The device according to claim 58, wherein the outlet orifice is oriented substantially in the direction of travel of the applicator member as the product is applied to hair.

65. The device according to claim 58, further comprising a dispensing element capable of being actuated to allow the product to be dispensed from the container.

66. The device according to claim 58, wherein the outlet orifice is located near a free end of the at least one tooth having the duct.

67. The device according to claim 66, wherein the outlet orifice is located at a distance ranging from about 0.5 mm to about 10 mm from the free end of the at least one tooth having the duct.

68. The device according to claim 58, wherein the dispensing head is configured such that the applicator member has an angular position that is adjustable with respect to the longitudinal axis of the at least one container.

69. The device according to claim 61, wherein the product is contained under pressure in the at least one container.

70. The device according to claim 69, further comprising a dispensing valve on the at least one container, and wherein the dispensing head includes a pressing surface capable of being pressed for actuating the dispensing valve to allow the product to be dispensed.

71. The device according to claim 58, wherein the dispensing head is formed of a single piece by molding.

72. A method of applying a product to hair, the method comprising:

providing the device according to claim 61;

dispensing the product from the container via the duct and the outlet orifice; and moving the applicator member along the hair to apply the product to the hair.

73. The method according to claim 72, further comprising orienting the outlet orifice in a direction substantially the same as a direction of motion of the applicator member.

74. The method according to claim 72, further comprising orienting the applicator member so that the product is not directed onto a scalp of a user.

75. A device for packaging and applying a product to hair, the device comprising:

at least one container having a longitudinal axis and being configured to contain the product; and a dispensing head configured to be coupled to the container, the dispensing head comprising an applicator member comprising a plurality of teeth comprising at least three teeth, the plurality of teeth being located in a plane that forms an acute angle with the longitudinal axis of the at least one container, a duct passing through an axial length of at least one of the plurality of teeth, the duct being capable of being placed in flow communication with the container, and an outlet orifice for the duct, the outlet orifice opening onto a surface of the at least one tooth having the duct.

76. The device of claim 75, wherein at least one of the plurality of teeth being intended, with a view to applying the product, to be engaged with the hair and moved longitudinally with respect thereto.

77. The device according to claim 75, further comprising the product in the at least one container, wherein the product is a hair composition.

78. The device according to claim 77, wherein the hair composition is in the form of a mousse.

79. The device according to claim 75, wherein the outlet orifice opens transverse to a substantial portion of the duct.

80. The device according to claim 75, wherein the outlet orifice is oriented substantially in the direction of travel of the applicator member as the product is applied to hair.

81. The device according to claim 75, further comprising a dispensing element capable of being actuated to allow the product to be dispensed from the container.

82. The device according to claim 75, wherein the outlet orifice is located near a free end of the at least one tooth having the duct.

83. The device according to claim 82, wherein the outlet orifice is located at a distance ranging from about 0.5 mm to about 10 mm from the free end of the at least one tooth having the duct.

84. The device according to claim 75, wherein the dispensing head is configured such that the applicator member has an angular position that is adjustable with respect to the longitudinal axis of the at least one container.

85. The device according to claim 77, wherein the product is contained under pressure in the at least one container.

86. The device according to claim 85, further comprising a dispensing valve on the at least one container, and wherein the dispensing head includes a pressing surface capable of being pressed for actuating the dispensing valve to allow the product to be dispensed.

87. The device according to claim 75, wherein the dispensing head is formed of a single piece by molding.

88. A method of applying a product to hair, the method comprising:

providing the device according to claim 77;

dispensing the product from the container via the duct and the outlet orifice; and moving the applicator member along the hair to apply the product to the hair.

89. The method according to claim 88, further comprising orienting the outlet orifice in a direction substantially the same as a direction of motion of the applicator member.

90. The method according to claim 88, further comprising orienting the applicator member so that the product is not directed onto a scalp of a user.

91. The device according to claim 1, wherein the screen is located between at least a portion of the container and the at least one tooth when the dispenser head is coupled to the container.

92. The device according to claim 1, wherein the screen is fixed relative to the at least one tooth.

93. The device according to claim 1, wherein the at least one tooth extends from the screen.

* * * * *